US005156342A

United States Patent [19]

Takeda et al.

[11] Patent Number: 5,156,342

[45] Date of Patent: Oct. 20, 1992

[54] ELECTROMAGNETIC FUEL INJECTION VALVE FOR INTERNAL COMBUSTION ENGINE

[75] Inventors: Hideto Takeda; Kazuyoshi Sugaya; Ryoichi Tada, all of Kariya; Oyuki Ogawa, Okazaki; Hisanori Kobayashi, Aichi; Satoshi Nakanishi, Kariya, all of Japan

[73] Assignee: Nippondenso Co. Ltd., Kariya, Japan

[21] Appl. No.: 866,252

[22] Filed: Apr. 9, 1992

Related U.S. Application Data

[60] Continuation of Ser. No. 763,503, Sep. 20, 1991, abandoned, which is a division of Ser. No. 428,437, Oct. 30, 1989, Pat. No. 5,080,287, which is a continuation of Ser. No. 110,504, Oct. 20, 1987, abandoned.

[30] Foreign Application Priority Data

| | | | |
|---|---|---|---|
| Oct. 24, 1986 | [JP] | Japan | 61-252960 |
| Feb. 27, 1987 | [JP] | Japan | 62-42945 |
| Sep. 4, 1987 | [JP] | Japan | 62-222768 |

[51] Int. Cl.[5] ..... F02M 55/00; F02M 51/06

[52] U.S. Cl. ..... 239/585.5; 239/585.1

[58] Field of Search ..... 239/533.9, 590.3, 585.1-585.5

[56] References Cited

U.S. PATENT DOCUMENTS

| | | | |
|---|---|---|---|
| 3,450,353 | 6/1969 | Eckert . | |
| 3,705,692 | 12/1972 | Garnier . | |
| 4,040,569 | 8/1977 | Knapp . | |
| 4,116,389 | 9/1978 | Furtah et al. | 239/585 |
| 4,153,205 | 5/1979 | Parrish, Jr. . | |
| 4,179,069 | 12/1979 | Knapp et al. . | |
| 4,230,273 | 10/1980 | Claxton et al. . | |
| 4,274,598 | 6/1981 | Wilfert et al. . | |
| 4,331,317 | 5/1982 | Kamai et al. . | |
| 4,339,082 | 7/1982 | Radaelli et al. | 239/585 |
| 4,385,339 | 5/1983 | Takada et al. | 239/585 X |
| 4,511,082 | 4/1985 | Ballik et al. . | |
| 4,519,547 | 5/1985 | Kubach et al. . | |
| 4,524,914 | 6/1985 | Kaibara et al. . | |
| 4,564,145 | 1/1986 | Takeda et al. . | |
| 4,573,659 | 3/1986 | Homes . | |
| 4,614,175 | 9/1986 | Asayama . | |
| 4,625,919 | 12/1986 | Soma et al. | 239/585 |
| 4,634,055 | 1/1987 | Hans et al. . | |
| 4,637,554 | 1/1987 | Takeda | 239/585 |
| 4,643,359 | 2/1987 | Casey . | |
| 4,651,931 | 3/1987 | Hans et al. . | |
| 4,657,189 | 4/1987 | Iwata et al. . | |
| 4,676,216 | 6/1987 | Ohsawa et al. . | |
| 4,676,478 | 6/1987 | Kiuchi | 239/585 X |
| 4,688,723 | 8/1987 | Kern et al. . | |
| 4,717,079 | 1/1988 | DeConcini . | |
| 4,726,389 | 2/1988 | Minoura et al. . | |
| 4,813,599 | 3/1989 | Greiner . | |

FOREIGN PATENT DOCUMENTS

| | | | |
|---|---|---|---|
| 330408 | 2/1920 | Fed. Rep. of Germany . | |
| 837337 | 3/1952 | Fed. Rep. of Germany . | |
| 2942928 | 5/1981 | Fed. Rep. of Germany | 239/585 |
| 52170123 | 12/1977 | Japan . | |
| 5348120 | 5/1978 | Japan . | |
| 31223 | 7/1983 | Japan . | |
| 33064 | 1/1984 | Japan . | |
| 5920562 | 2/1984 | Japan . | |
| 6088070 | 6/1985 | Japan . | |
| 184943 | 9/1985 | Japan | 239/585 |
| 60256552 | 12/1985 | Japan . | |
| 60256553 | 12/1985 | Japan . | |
| 61110864 | 7/1986 | Japan . | |
| 6275066 | 4/1987 | Japan . | |
| 968507 | 10/1982 | U.S.S.R. . | |
| 738769 | 10/1955 | United Kingdom . | |
| 8700584 | 1/1987 | World Int. Prop. O. | |

*Primary Examiner*—Andres Kashnikow
*Assistant Examiner*—William Grant
*Attorney, Agent, or Firm*—Cushman, Darby & Cushman

[57] ABSTRACT

An electromagnetic fuel injection valve for use in an internal combustion engine includes a valve body provided with a valve seat and a valve member having an abutting part moved within the valve body by an electromagnetic actuator between a closed position where the abutting part abuts against the valve seat to interrupt supply of fuel to the engine and an open position where the abutting portion is spaced from the valve seat to permit supply of the fuel to the engine. The valve member has a metering portion which cooperates with the valve seat to define therebetween a fuel metering gap when the valve member is in the open position. The abutting part of the valve member is located downstream of the metering portion with reference to a flow direction of the fuel so that the metering portion is always immersed in the fuel when the valve member is in the closed position.

9 Claims, 17 Drawing Sheets

ELECTROMAGNETIC FUEL INJECTION VALVE FOR INTERNAL COMBUSTION ENGINE

This is a continuation of application Ser. No. 07/763,503, filed on Sept. 20, 1991, which was abandoned upon the filing hereof, which was a division of Ser. No. 07/428,437, filed Oct. 30, 1987, now U.S. Pat. No. 5,080,287, which was a continuation of Ser. No. 07/110,504 filed Oct. 20, 1987, now abandoned.

FIELD OF THE INVENTION AND RELATED ART STATEMENT

The present invention relates to an electromagnetic fuel injection valve for supplying fuel to an internal combustion engine.

The electromagnetic fuel injection valve of the type referred to above generally comprises a valve body formed with a valve seat, and a valve member provided with an abutting part. The valve member is arranged for movement relative to the valve body between a closed position where the abutting part abuts against the valve seat to interrupt a supply of fuel to the engine and an open position where the abutting part is away from the valve seat to permit the supply of the fuel to the engine. The valve member is actuated by an electromagnetic actuator to move between the open and the closed positions. The valve member has a metering portion which cooperates with the valve seat to define therebetween a fuel metering gap when the valve member is in the open position. The abutting part of the valve member is located upstream of the metering portion with reference to the flow direction of the fuel.

The electromagnetic fuel injection valve as described above is mounted to the engine to inject the fuel into a cylinder or an intake pipe of the engine. Accordingly, at least one end portion of the valve body and the valve member are exposed to an interior of the cylinder or an interior of the intake pipe. For this reason, the combustion residue or the evaporation residue in the fuel tends to be deposited and accumulated on the surfaces of the end portion of the valve body and the valve member. Such deposition and accumulation of the residue are not likely to occur during fuel injection, i.e., when the valve member is in the open position, but tend to occur during interruption of the fuel injection, i.e., when the valve member is in the closed position.

In the above-described conventional electromagnetic fuel injection valve, since the abutting part of the valve member is located upstream of the metering portion of the valve member, the metering portion is in direct communication with the interior of the cylinder or the interior of the intake pipe when the valve member is in the closed position, so that the residue is deposited and accumulated on the metering portion and on a portion of the valve seat which cooperates with the metering portion to define therebetween the fuel metering gap. This causes the effective opening area of the fuel metering gap to be gradually reduced, resulting in a decrease in the fuel flow rate, thereby decreasing the engine performance.

In order to solve the above-discussed problem, a proposal has been made in Japanese Utility Model Application Laid-Open No. 61-110864, in which a portion of the valve member in direct communication with the interior of the cylinder or the interior of the intake pipe at a location downstream of the abutting part are brought to 0.1 μm or less in surface roughness to eliminate catching of the residue at the fuel metering portion, thereby preventing deposition and accumulation of the residue. However, it causes remarkable machining difficulties to bring the surface roughness to 0.1 μm or less.

OBJECT AND SUMMARY OF THE INVENTION

It is an object of the invention to provide an electromagnetic fuel injection valve for use in an internal combustion engine, which can effectively prevent a reduction in fuel flow rate due to deposition and accumulation of residue without the necessity of highly precise machining.

According to the invention, there is provided an electromagnetic fuel injection valve comprising a valve member which has a metering portion cooperating with a valve seat to define therebetween a fuel metering gap, and an abutting part located downstream of the metering portion with reference to a flow direction of fuel, so that the metering portion is always immersed in the fuel when the valve member is in a closed position.

DETAILED DESCRIPTION

Various embodiments of the invention will be described in detail with reference to the accompanying drawings.

Figure 1:
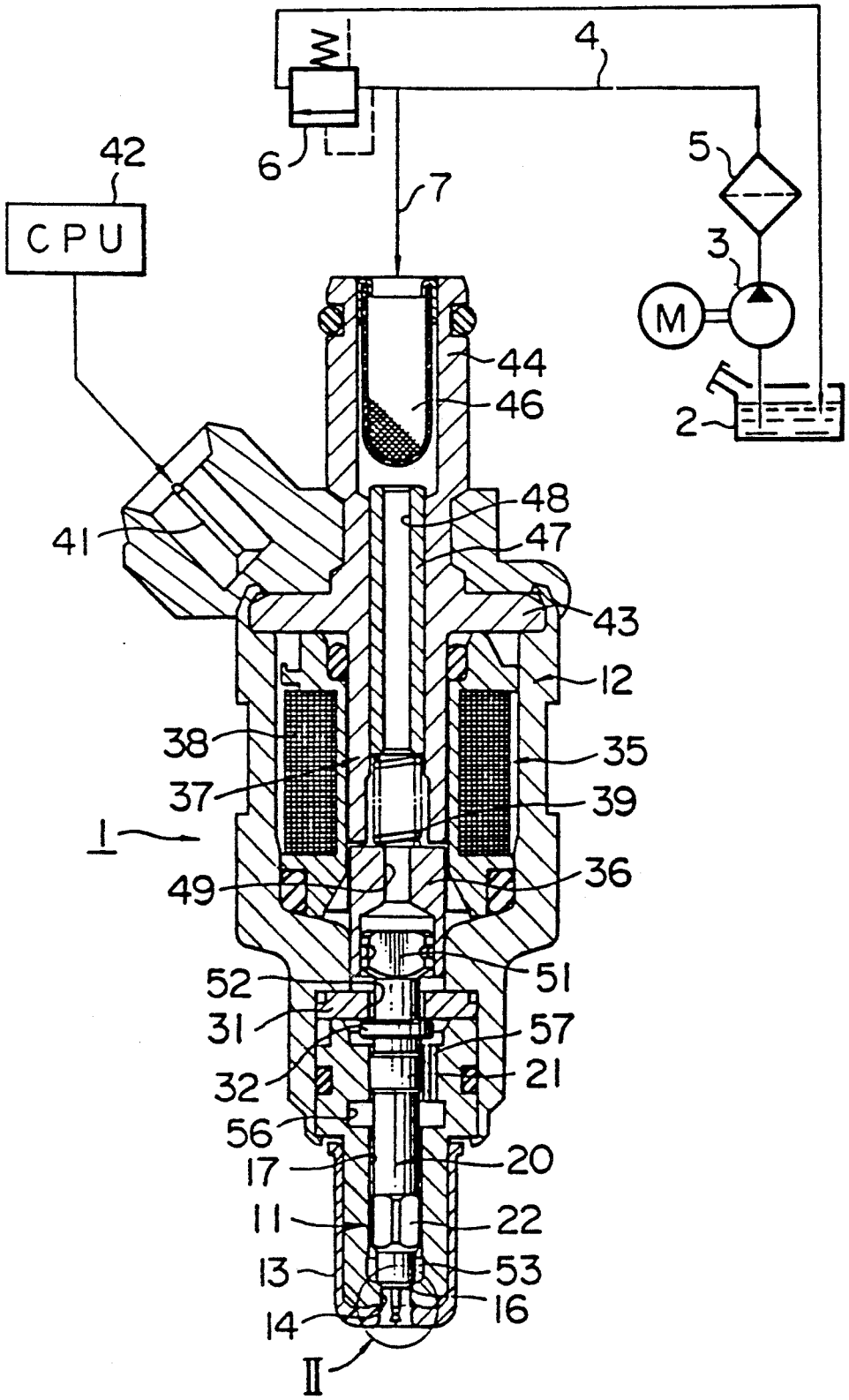
FIG. 1 is a longitudinal cross-sectional view showing an electromagnetic fuel injection valve for an internal combustion engine according to an embodiment of the invention.

Referring first to FIGS. 1 to 4, in particular, to FIG. 1, there is illustrated a fuel supply system which has incorporated therein an electromagnetic fuel injection valve 1 for an internal combustion engine, according to an embodiment of the invention, and which is suitable for use in vehicles, for example. The fuel supply system comprises a fuel tank 2. Fuel forcibly delivered from the fuel tank 2 by an electromagnetic pump 3 is fed to a supply line 4 through a filter 5, and is supplied to a pressure control valve 6 through the supply line 4. The pressurized fuel within the supply line 4 is delivered to the fuel injection valve 1 through a branch pipe 7. The fuel injection valve 1 is, in general, adapted to supply the fuel into an intake pipe or a cylinder of the internal combustion engine of the spark ignition type. As the fuel, gasoline is used which is relatively low in vapor pressure. Supply pressure of the fuel by the fuel injection valve 1 is a relatively low value on the order of 250 kPa, and is regulated by the pressure control valve 6 to a constant differential pressure with respect to a pressure within the intake pipe.

The electromagnetic fuel injection valve 1 shown in FIG. 1 comprises a valve body 11 and a valve case 12. The valve case 12 is bent at an end portion thereof and pressed or caulked against the valve body 11 to connect them together. A case cover 13 is force-fitted about the valve body 11. As shown in detail in FIG. 2, the valve body 11 is provided with an injection hole 14 through which the metered fuel is injected into the cylinder or the intake pipe, and a valve seat 16 formed into a frustoconical surface.

Figure 2:
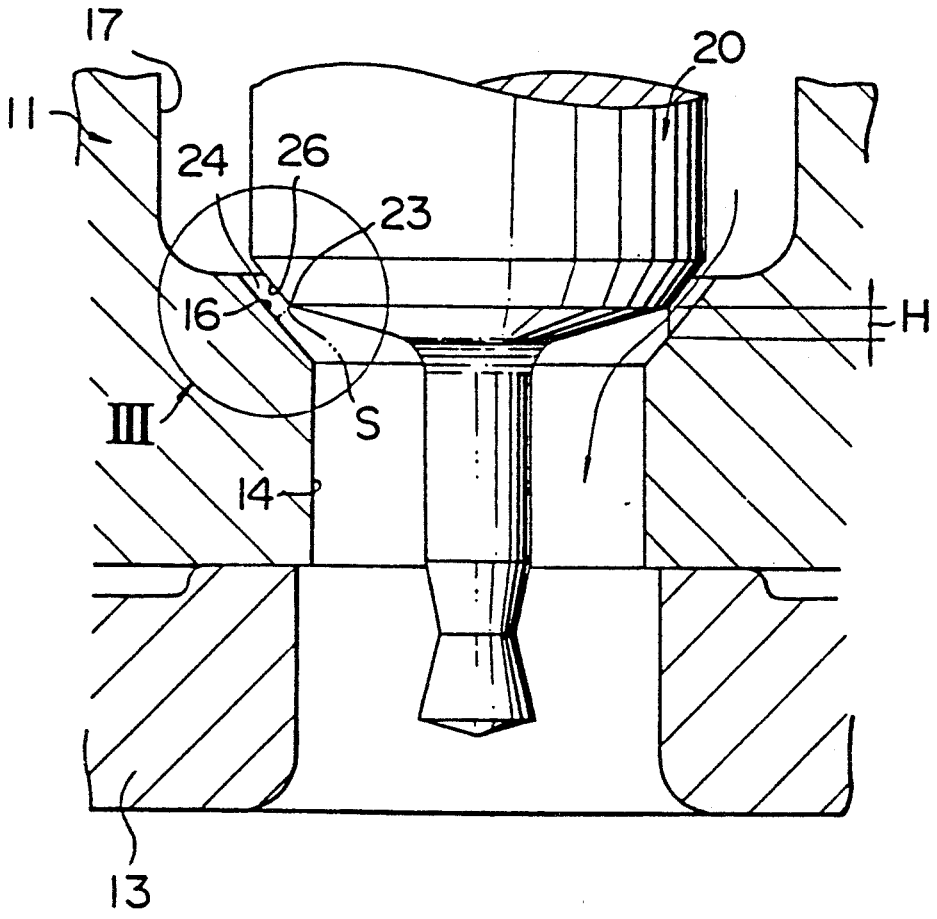
FIG. 2 is a fragmental enlarged cross-sectional view of a valve member of the fuel injection valve encircled by II in FIG. 1.
Figure 3:
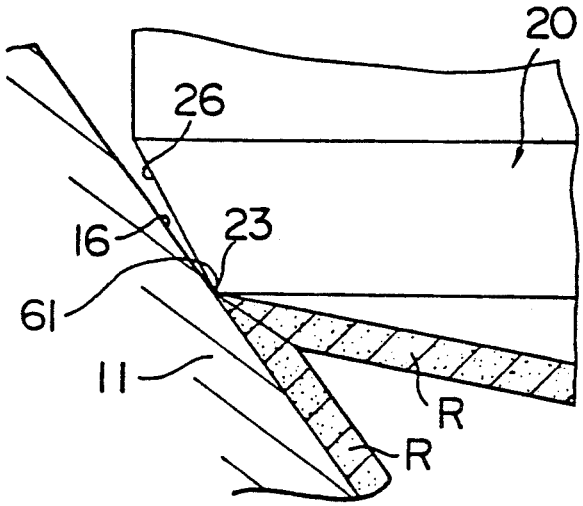
FIGS. 3 and 4 are enlarged views of a portion of the valve member encircled by III in FIG. 2 in a closed position and in an open position, respectively.
Figure 4:
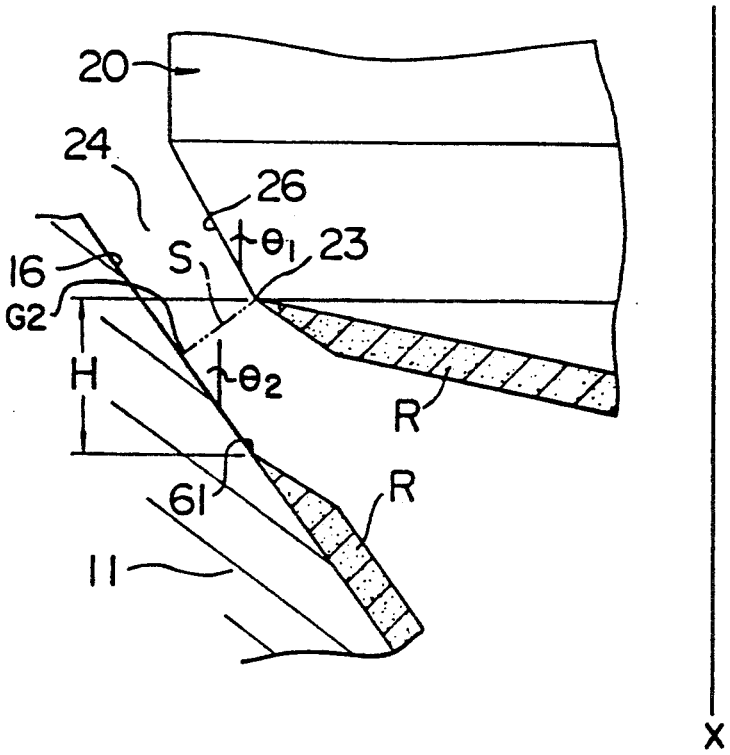

Referring back to FIG. 1, the valve body 11 is provided with a guide bore 17. An elongate valve member 20 of needle type received in the guide bore 17 is provided with two sliding sections 21 and 22. They are engaged with the guide bore 17 with a gap of few μm left between a wall surface of the guide bore 17 and walls of the sliding sections 21 and 22, in order to allow the valve member 20 to slide smoothly. As shown in FIGS. 2 to 4, the valve member 20 is arranged within the guide bore 17 for movement relative to the valve body 11 between a closed position illustrated in FIG. 3 and an open position illustrated in FIG. 4. In the closed position an abutting part 23 provided on the valve member 20 abuts against the valve seat portion 61 of the valve seat 16 to close the injection hole 14 thereby interrupting a supply of the fuel into the engine. In the open position the abutting part 23 is spaced from the valve seat 16 by an amount of lift H to open the injection hole 14 thereby permitting a supply of the fuel into the engine.

The valve member 20 has an frustoconical surface 26. The inclination angle $\theta_1$ of frustoconical surface 26 to the axis X is preferably smaller than the inclination angle $\theta_2$ of the valve seat 16 to the axis X. The valve body 11 is provided with a metering portion 62 which cooperates with the abutting part 23 to define a minimum fuel metering gap 24 between the valve body 11 and the valve seat 16. The gap 24 has a metering area S, thereby the metered fuel is injected from the fuel injection hole 14. As will be clear from FIG. 4, the metering portion 62 is located upstream of the valve seat portion 61 with reference to the flow direction of fuel flowing through the fuel injection valve 1.

Referring back to FIG. 1, a disc-shaped stopper 31 is fixedly interposed between a rear end of the valve body 11 and the valve case 12. A flange 32 on the valve member 20 is adapted to abut against the stopper 31 to determine the open position of the valve member 20. The valve member 20 extends at a rear end portion thereof into the valve case 12 through the stopper 31.

Arranged within the valve case 12 is an electromagnetic actuator 35 for actuating the valve member 20 to move between the closed position illustrated in FIG. 3 and the open position illustrated in FIG. 4. The electromagnetic actuator 35 comprises an armature 36 connected to the rear end of the valve member 20, a stator 37 disposed stationary relative to the valve case 12 and then to the valve body 11, and an electromagnetic coil 38 wound around the stator 37. The armature 36 is biased by a coiled return spring 39 toward the closed position, i.e., downwardly as viewed in FIG. 1. As electric current is supplied to the electromagnetic coil 38, an electromagnetic force is generated which causes the armature 36 to be attracted toward the stator 37 against a biasing force of the return spring 39. When the flange 32 is abutted against the stopper 31, the valve member 20 occupies the open position illustrated in FIG. 4. As the supply of electric current to the magnetic coil 38 is interrupted, the valve member 20 is moved away from the stator 37 by the biasing force of the return spring 39. When the abutting part 23 of the valve member 20 is abutted against the valve seat 16, the valve member 20 occupies the closed position illustrated in FIG. 3. The electromagnetic coil 38 is connected to an electronic control circuit (CPU) 42 including a microcomputer, through a terminal 41. The CPU 42 is adapted to control a supply of the electric current to the electromagnetic coil 38.

The stator 37 is integrally provided with a flange 43 which is fixedly mounted to a rear end of the valve case 12. A coupling portion 44 to be connected to the branch pipe 7 is a portion of the flange 43 extending from an end face thereof opposite to the stator 37. A filter 46 is disposed within the coupling portion 44. An adjusting pipe 47 is disposed in the stator 37 for adjusting the biasing force of the return spring 39. An internal passage 38 in the adjusting pipe 47 communicates at an upstream end thereof with the branch pipe 8 through the coupling portion 44, and at a downstream end thereof with the above-described fuel metering gap 24 through a central bore 49 formed in the armature 36, a gap around the outer peripheral surface of the armature 36, flat surface portion 51 of the valve member 20, a central bore 52 in the stopper 31, and a fuel passage 53 between the valve member 20 and the wall surface of the guide bore 17. Thus, when the valve member 20 occupies the open position shown in FIG. 4, the pressurized fuel from the branch pipe 8 is injected from the injection hole 14 into the cylinder or the intake pipe through the gap 24.

An enlarged annular void 56 is formed in the valve body 11 at a location upstream of the fuel metering gap 24 with reference to the above-described fuel flow direction. Also formed in the valve body 11 is an orifice 57 which communicates with the annular void 56 so as to communicate the upstream and downstream locations of the sliding section 21 of the valve member 20 with each other. The orifice 57 forms fuel metering means for metering the fuel delivered to the fuel metering gap 24. In the illustrated embodiment, the orifice 57 is set to control 20% to 50% of a predetermined pressure loss, and the fuel metering gap 24 is set to control the remaining pressure loss.

The operation of the above-described electromagnetic fuel injection valve 1 for the internal combustion engine will be described hereinunder. When no electric current is supplied from the CPU 42 to the electromagnetic coil 38 of the electromagnetic actuator 35, the valve member 20 occuppies the closed position shown in FIG. 3 under the biasing force of the return spring 39. In the closed position, the abutting part 23 of the valve member 20 abuts against the valve seat portion 61 of the valve body 11 to interrupt supply of the fuel to the engine. During the occupancy in the closed position shown in FIG. 3, a combustion residue R within the cylinder or the intake pipe or an evaporation residue R in the fuel is deposited and accummulated on a surface of a portion of the valve seat 16 which portion is located downstream of the valve seat portion 61 and on a surface of a portion of the valve member 20 which portion is located downstream of the abutting part 23. During the occupancy in the closed position, however, since portions of the respective valve member 20 and the valve seat 16, which are located upstream of the abutting valve seat portion 23 and the part 61, respectively, are out of direct communication with the interior of the cylinder or the interior of the intake pipe by the abutting part 23, the residue R is neither deposited nor accumulated on the surfaces of such portions.

As electric current is supplied from the CPU 42 to the electromagnetic coil 38, the valve member 20 is attracted towards the stator 37 against the biasing force of the return spring 39 and is moved by the amount of lift H until the flange 32 abuts against the stopper 31, so that the valve member 20 occupies the open position shown in FIG. 4. The pressurized fuel from the branch pipe 7 is injected into the cylinder or the intake pipe through the filter 46, the internal passage 48, the central bore 49, the flat portions 51, the central bore 52, the orifice 57, the annular void 56, the fuel passage 53, the fuel metering gap 24 and the injection hole 14. As will be clear from FIG. 4, when the valve member 20 occupies the open position, the fuel is metered by the orifice 57 and the metering gap 24. Since no residue is deposited and accumulated on the metering portion 62 of the valve body 11 and on the abutting part 23 which cooperates with the metering portion 62 to define therebetween the gap 24, the metering area S of the gap 24 is not influenced by the residue and can always perform a constant metering function.

In the fuel injection valve 1 illustrated in FIGS. 1 to 4, the orifice 57 located upstream of the gap 24 is set to control 20% to 50% of the predetermined pressure loss, which is a generally used value, and the gap 24 is set to control the remaining pressure loss. Therefore, the pressure does not excessively decrease at the metering section, i.e., at the gap 24. Thus, there is no possibility that the excessive decrease in pressure causes the fuel to be evaporated at the valve seat 16 under high temperature and negative pressure, to abruptly reduce the amount of injection.

Although the fuel injection valve 1 illustrated in FIGS. 1 to 4 has been described as having the orifice 57 which controls 20% to 50% of the predetermined pressure loss, the orifice 57 is not essential, for the gap 24 may control substantially 100% of the predetermined pressure loss. That is, the arrangement may be such that the metering of the fuel is completed at a location upstream of the abutting part 23 of the valve member 20, and no metering is not effected downstream of the abutting part 23. This makes it possible to relatively increase the flow passage area downstream of the abutting part 23 or the valve seat portion 61 to be abutted. Thus, the injection hole 14 directly communicating with the interior of the cylinder or the interior of the intake pipe can increase in diameter, for example, and precise surface machining on the injection hole 14 and the like can be dispensed with.

Figure 5:
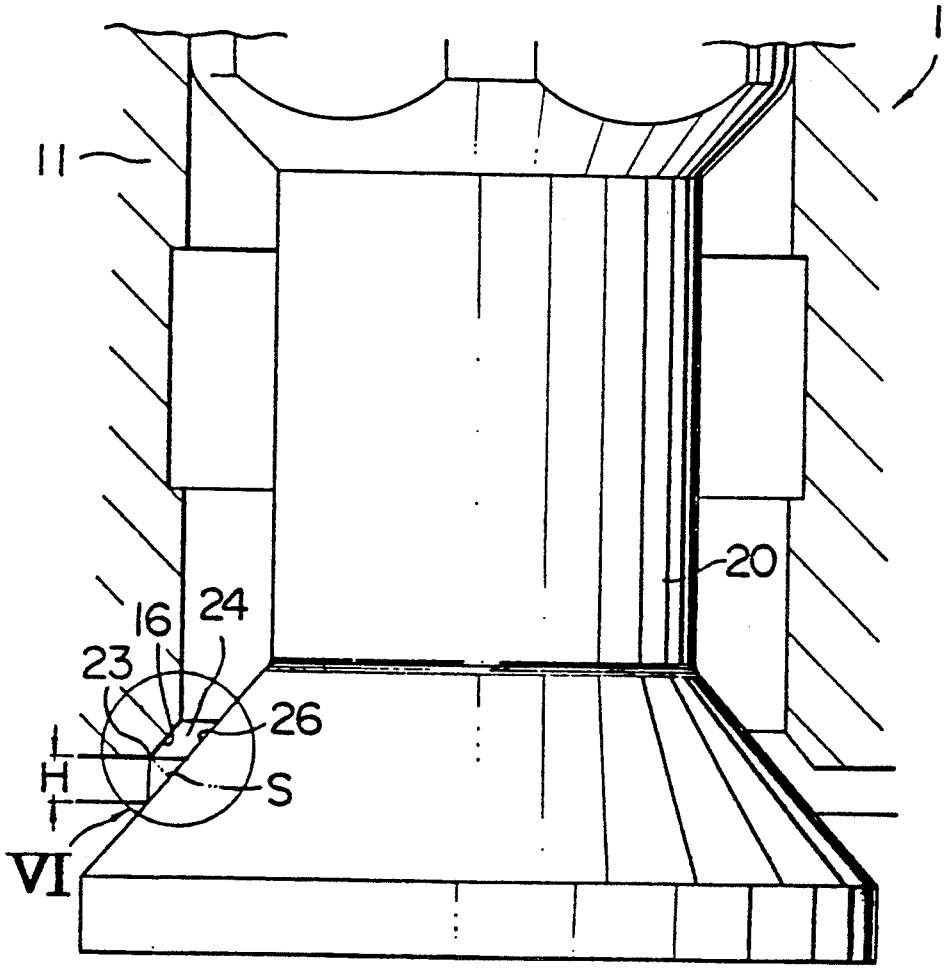
FIG. 5 is a fragmental cross-sectional view showing an embodiment in which the invention is applied to an injection valve of the outwardly open type.
Figure 6:
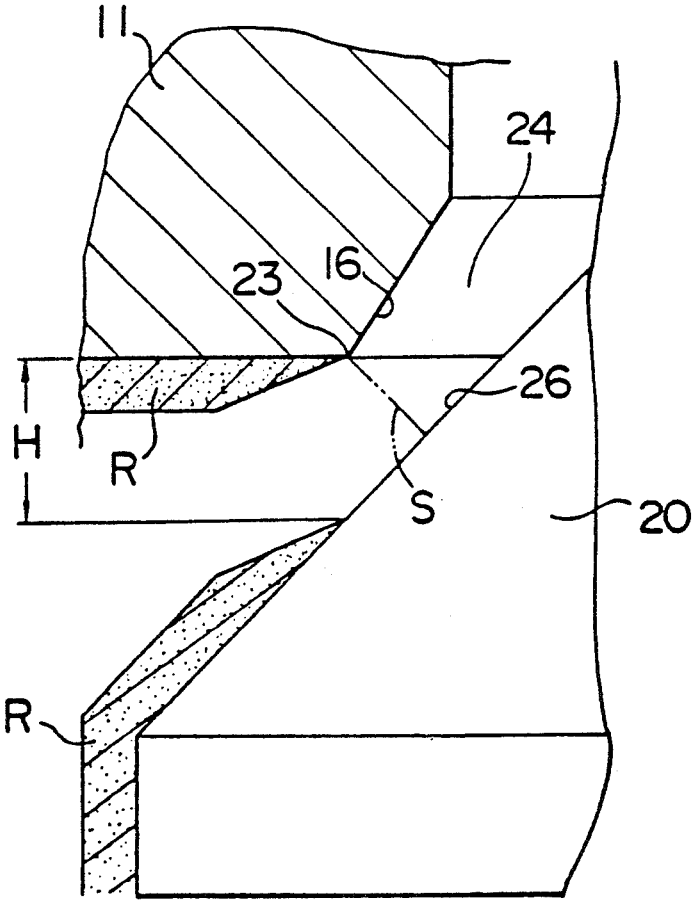
FIG. 6 is an enlarged view of a portion encircled by VI in FIG. 5.

The fuel injection valve 1 illustrated in FIGS. 1 to 4 is of a so-called inwardly open type in which the rear end of the valve member 20 moves away from a downstream end of the valve body 11 when the valve member 20 is moved by the electromagnetic actuator 35 from the closed position shown in FIG. 3 to the open position shown in FIG. 4. As illustrated in FIGS. 5 and 6, however, the invention is equally applicable to a fuel injection valve 1 of the so-called outwardly open type in which the rear end of the valve member 20 moves toward the downstream end of the valve body 11 when the valve member 20 is moved by the electromagnetic actuator 35 from the closed position to the open position shown in FIGS. 5 and 6. In connection with the embodiment shown in FIGS. 5 and 6, the same reference numerals are used to designate the same parts and components as those shown in FIGS. 1 to 4, and the description of the operation of such embodiment will therefore be omitted.

Figure 7:
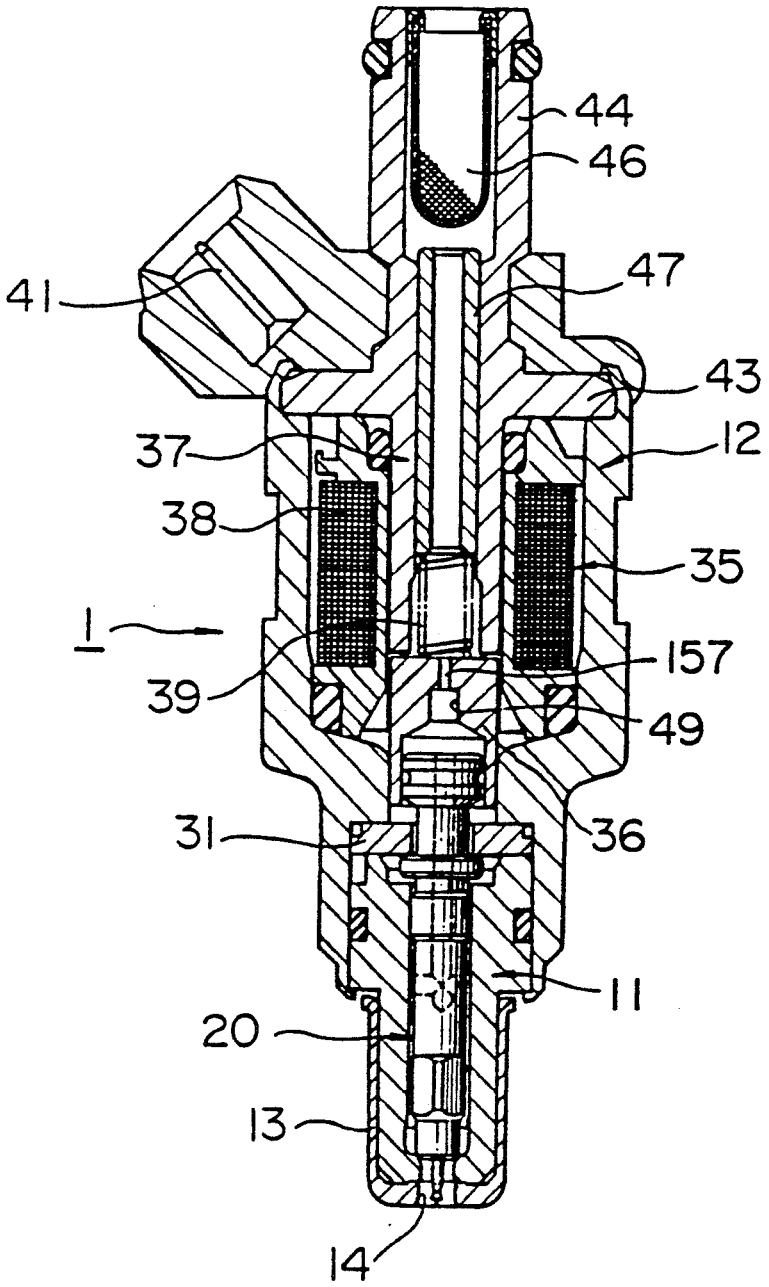
FIG. 7 is a view similar to FIG. 1, but showing a fuel injection valve according to another embodiment of the invention.
Figure 8:
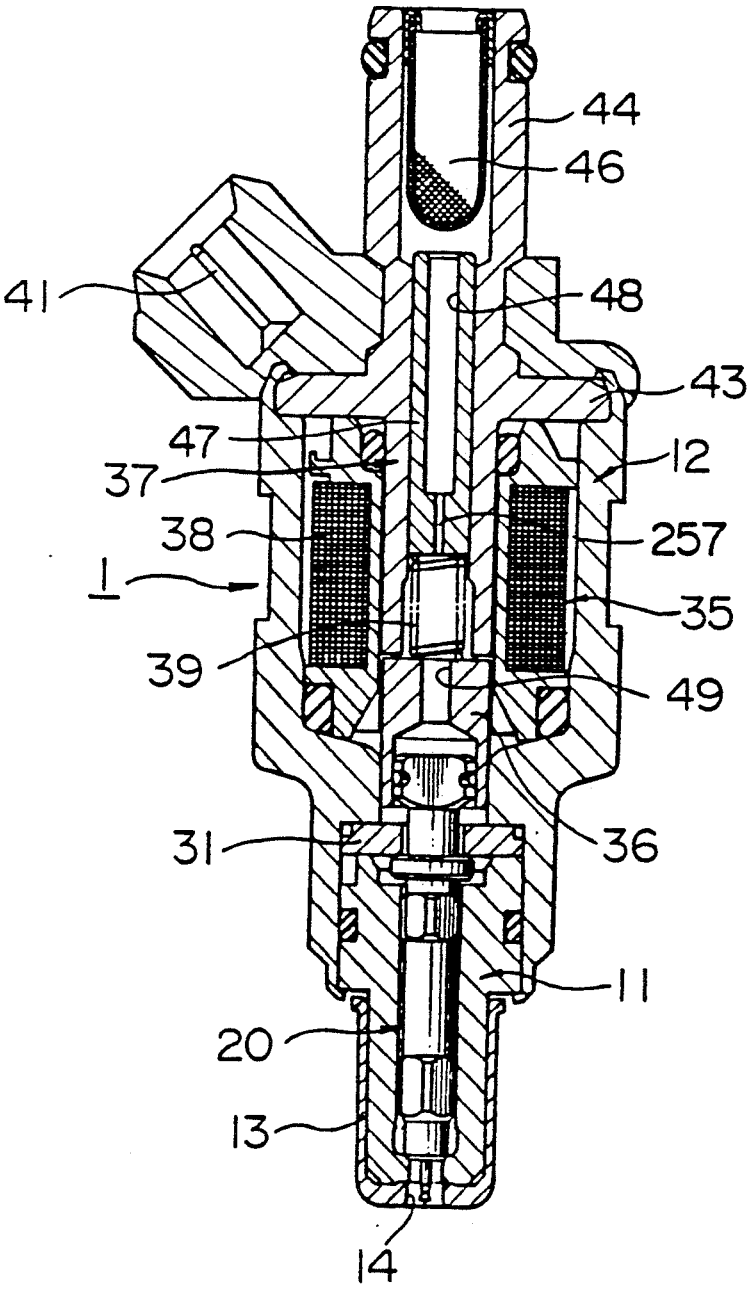
FIG. 8 is a view similar to FIG. 1, but showing a fuel injection valve according to still another embodiment of the invention.

Further, although the embodiment illustrated in FIGS. 1 to 4 has been described as having the fuel metering means for metering the fuel delivered to the gap 24, which is constituted by the orifice 57 directly formed in the valve body 11, another embodiment may have an orifice 157 corresponding to the orifice 57 provided at the central bore 49 in the armature 36 as illustrated in FIG. 7. Alternatively, as in an embodiment illustrated in FIG. 8, an orifice 257 corresponding to the orifice 57 in the embodiment illustrated in FIGS. 1 to 4 may be provided at the internal passage 48 in the adjusting pipe 47.

Figure 9:
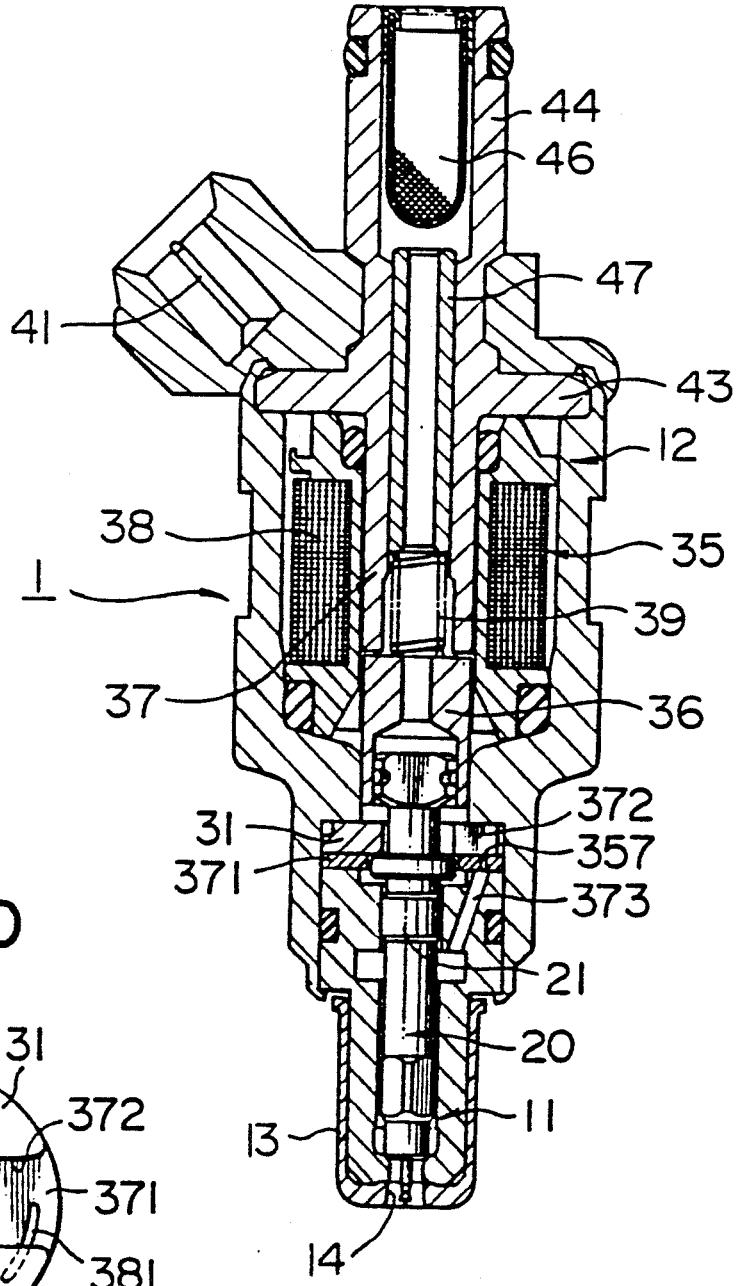
FIG. 9 is a view similar to FIG. 1, but showing a fuel injection valve according to another embodiment of the invention.

As a further alternative embodiment, as illustrated in FIG. 9, a disc 371 may be fixedly interposed between the rear end face of the valve body 11 and the stopper 31, and an orifice 357 corresponding to the orifice 57 in the embodiment illustrated in FIGS. 1 to 4 may be formed in the disc 371. In this case, a cut-out portion 372 is formed in the stopper 31 and a communication passage 373 is formed in the valve body 11 to communicate the upstream and the downstream locations of the sliding section 21 with each other.

Figure 10:
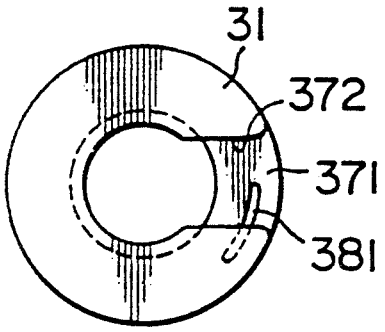
FIG. 10 is a plan view showing a modification of the embodiment illustrated in FIG. 9.

Alternatively, as illustrated in FIG. 10, in place of the above-mentioned orifice 357, an arcuate slot 381 may be employed, which is formed in the disc 371. In this case, the stopper 31 and the disc 371 are so arranged as to be angularly movable relative to each other to vary an opening area of the slot 381 exposed within the cut-out portion 372.

Another embodiment of the invention will be described with reference to FIGS. 11 to 16.

Figure 11:
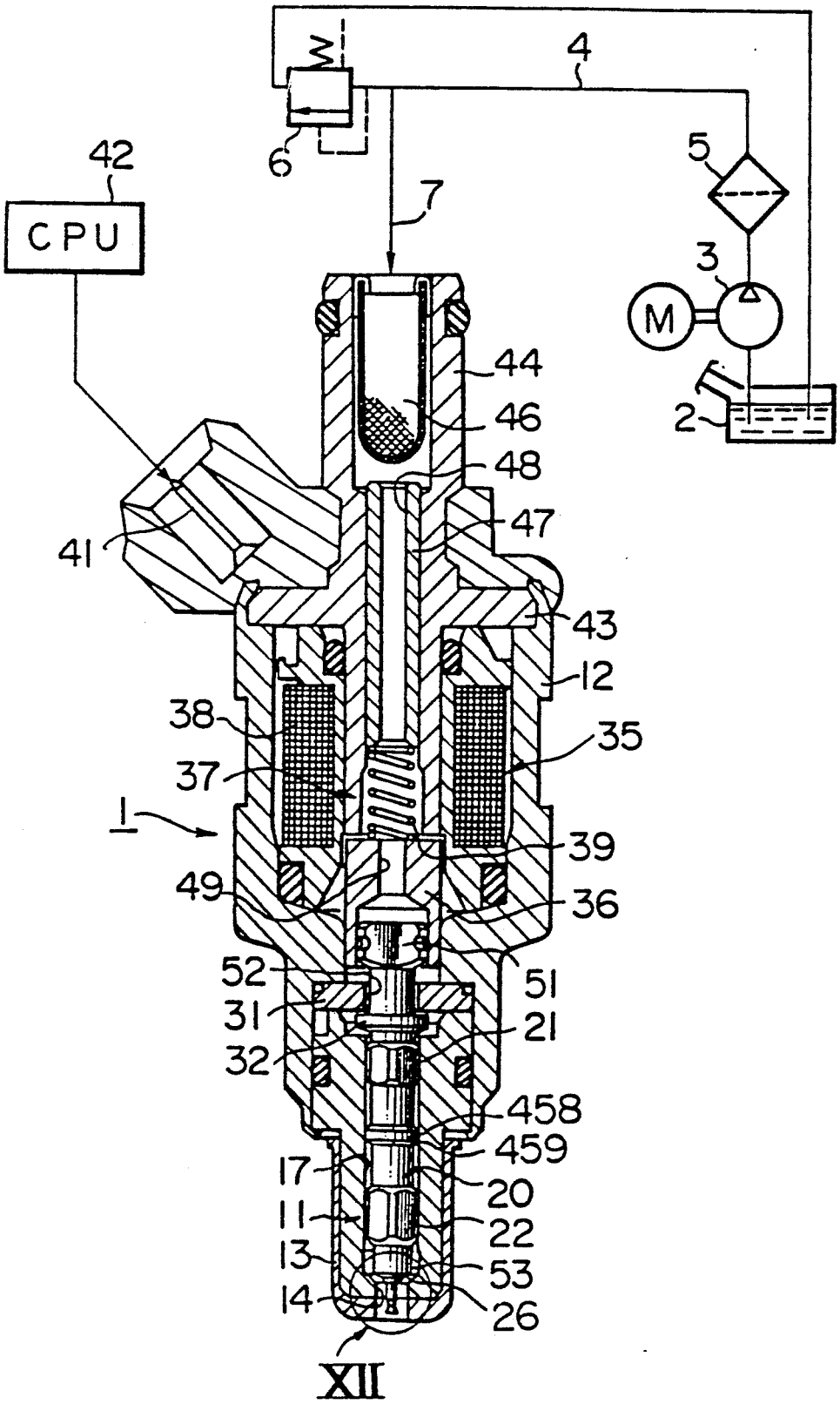
FIG. 11 is a view similar to FIG. 1, but showing a fuel injection valve according to still another embodiment of the invention.
Figure 12:
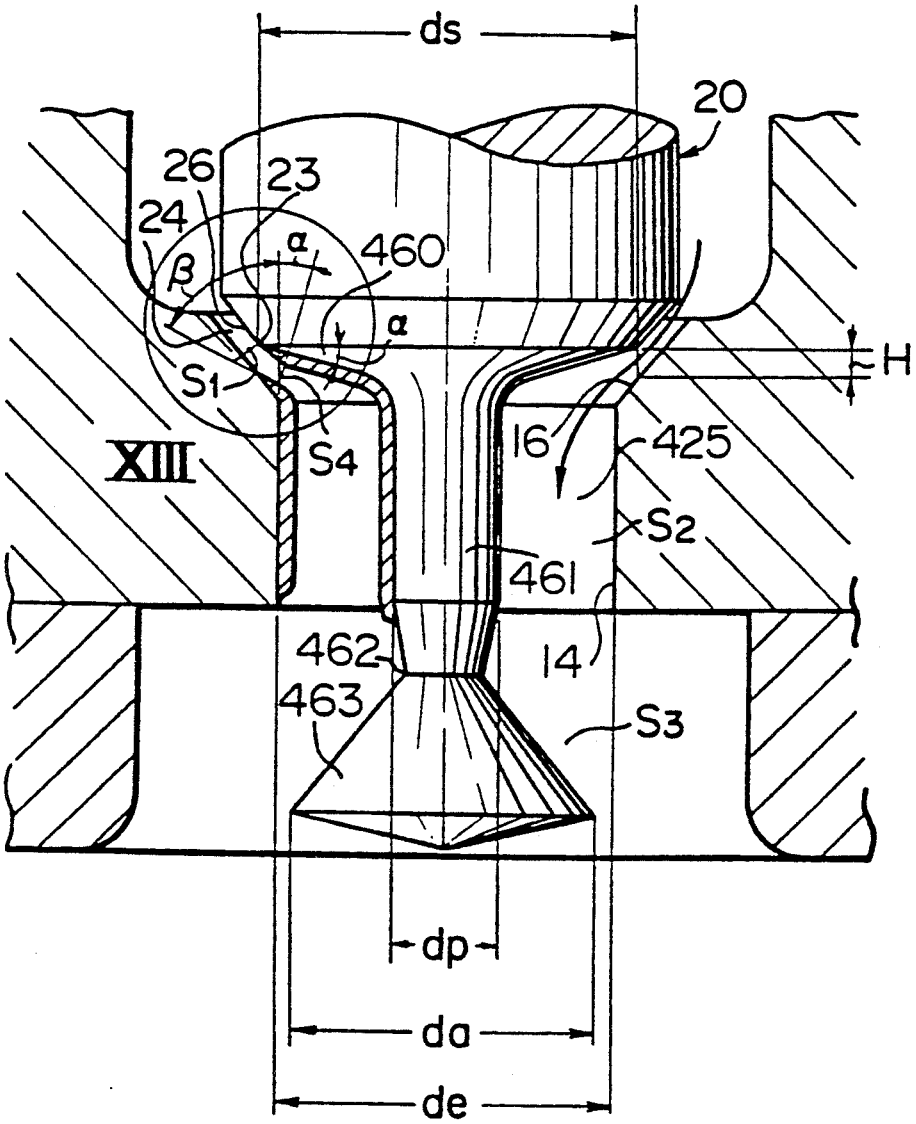
FIG. 12 is a fragmental enlarged view of a portion of the fuel injection valve encircled by XII in FIG. 11.

As shown in FIG. 11, in the embodiment the valve member 20 is provided with a flange 458 at a location upstream of the metering portion 26 with reference to the flow direction of fuel. The flange 458 cooperates with the wall surface of the guide bore 17 to define therebetween a gap 459 of few tens μm. The gap 459 forms fuel metering means for metering fuel delivered to the fuel metering gap 24 (FIG. 12). In the illustrated embodiment, the gap 459 is set to take control 20% to 50% of a predetermined pressure loss.

In the embodiment illustrated in FIG. 11, a gap 425 (FIG. 12) between the injection hole 14 and a pin section 461 of the valve member 20 is set to control 20% or less, desirably 5% or less of the entire pressure loss.

In general, the following relationship exists between a metering area $S_m$ and an amount of injection Q:

$$Q = CS_m\sqrt{\frac{2gP_f}{\gamma}} \tag{1}$$

where

C is a flow coefficient;

g is a gravitational conversion coefficient;

$P_f$ is a supplied pressure; and $\gamma$ is a specific weight of fuel.

In case of multiple stages of metering sections such as a metering section having an area $S_0$ at the gap and a metering section having an area $S_1$ at the gap 24 in the illustrated embodiment, the above equation (1) can be expressed as follows:

$$Q = \frac{1}{\sqrt{\left(\frac{1}{C_0S_0}\right)^2 + \left(\frac{1}{C_1S_1}\right)^2 + \ldots + \left(\frac{1}{C_nS_n}\right)^2}}\sqrt{\frac{2gP_f}{\gamma}} \tag{2}$$

Each of the flow coefficients $C_0, C_1 \ldots C_n$ is on the order of 0.8 to 0.9, and they are not so much different from each other.

Further, since the flow passage areas $S_i$ in the fuel injection valve 1 illustrated in FIG. 11 except for the area $S_0$ of the fuel metering gap 459 and the area $S_1$ at the metering portion 26 are so set as to satisfy the relationship $S_0 << S_i$ and $S_1 >> S_i$, the above equation (2) may actually be expressed as follows:

$$Q = \frac{1}{\sqrt{\left(\frac{1}{C_0S_0}\right)^2 + \left(\frac{1}{C_1S_1}\right)^2}}\sqrt{\frac{2gP_f}{\gamma}} \tag{3}$$

If it is supposed that $C_1 \approx C_2$, $$Q = \frac{C}{\sqrt{\left(\frac{1}{S_0}\right)^2 + \left(\frac{1}{S_1}\right)^2}}\sqrt{\frac{2gP_f}{\gamma}} = CS_0\sqrt{\frac{2gP_0}{\gamma}} = CS_1\sqrt{\frac{2gP_1}{\gamma}} \tag{4}$$

$$P_0 + P_1 = P_f$$

where $P_0$ is a pressure loss corresponding to the area $S_0$ of the fuel metering gap 459; and $P_1$ is a pressure loss corresponding to the area $S_1$ at the metering portion 26.

That is to say, if the gap 459 controls 20% to 50% of the predetermined pressure loss, then $P_0/P_f = 20\%$ to 50%. From the equation (4), the following relationship exists:

$$\frac{P_f}{\left(\frac{1}{S_0}\right)^2 + \left(\frac{1}{S_1}\right)^2} = S_0^2P_0$$

Therefore, $$\frac{S_0}{S_1} = \sqrt{\frac{P_f}{P_0} - 1} \tag{5}$$

Thus, from the equation (5), the areas should be set in the following manner:

$$\text{When } \frac{P_0}{P_f} = 50\%, \quad \frac{S_0}{S_1} \approx 1,$$

and $$\text{When } \frac{P_0}{P_f} = 20\%, \quad \frac{S_0}{S_1} \approx 2$$

Moreover, the area $S_2$ of the gap 425 at the injection hole 14 can be calculated by the use of the equation (5) with respect to an equivalent area Se of the areas $S_0$ and $S_1$. That is, the following relationship exists:

$$\frac{S_2}{Se} = \sqrt{\frac{P_f}{P_2} - 1} \tag{6}$$

where $$\left(\frac{1}{Se}\right)^2 = \left(\frac{1}{S_0}\right)^2 + \left(\frac{1}{S_1}\right)^2$$

Accordingly, the area $S_2$ can be set in the following manner:

$$\text{When } \frac{P_2}{P_f} = 20\%, \quad \frac{S_2}{Se} \approx 2.$$

and $$\text{When } \frac{P_2}{P_f} = 5\%, \quad \frac{S_2}{Se} \approx 4.36$$

As shown in FIG. 12, the abutting part 23 of the valve member 20 is located downstream of the metering portion 26 with reference to the flow direction of the fuel. The valve member 20 has an end portion downstream of the abutting part 23, which consists of a tapered frustoconical section 460, a columnar pin section extending from the section 460, a tapered section extending from the pin section 461, and a flared section 463 extending from the tapered section 462. Thus, the metered fuel from the metering portion 26 flows downstream along the frustoconical section 460, the pin section 461, the tapered section 462 and the flared section 463 and is injected at a predetermined spray angle. As described previously, the gap 425 between the injection hole 14 and the pin section 461 of the valve member 20 is set to control 20% or less, desirably 5% or less of the entire pressure loss. The remaining construction of the embodiment illustrated in FIGS. 11 and 12 is similar to that of the embodiment illustrated in FIGS. 1 to 4. In FIGS. 11 and 12, the same reference numerals are used to designate the same parts and components as those shown in FIGS. 1 to 4, and the description of such parts and components will therefore be omitted.

During use of the above-described fuel injection valve 1 incorporated in the fuel supply system, the combustion residue R within the cylinder or the intake pipe or the evaporation residue R in the fuel is deposited and accumulated not only on the outer periphery of the pin section 461 but on the wall surface of the injection hole 14 as shown in FIG. 12. Accumulation of the residue R causes a reduction in the amount of injection. In particular, as the reduction ratio of the amount of injection due to the accumulation of the residue reaches 20% or more, the engine performance is remarkably reduced. Accordingly, in order to prevent the reduction in the performance of the engine due to the reduction of injection, the reduction ratio in the amount of injection must be restrained to 10% or less. To this end, the reduction degree of the amount of injection is required to be at most one fifth of that of the conventionally known electromagnetic injection valve illustrated in FIG. 17.

Figure 17:
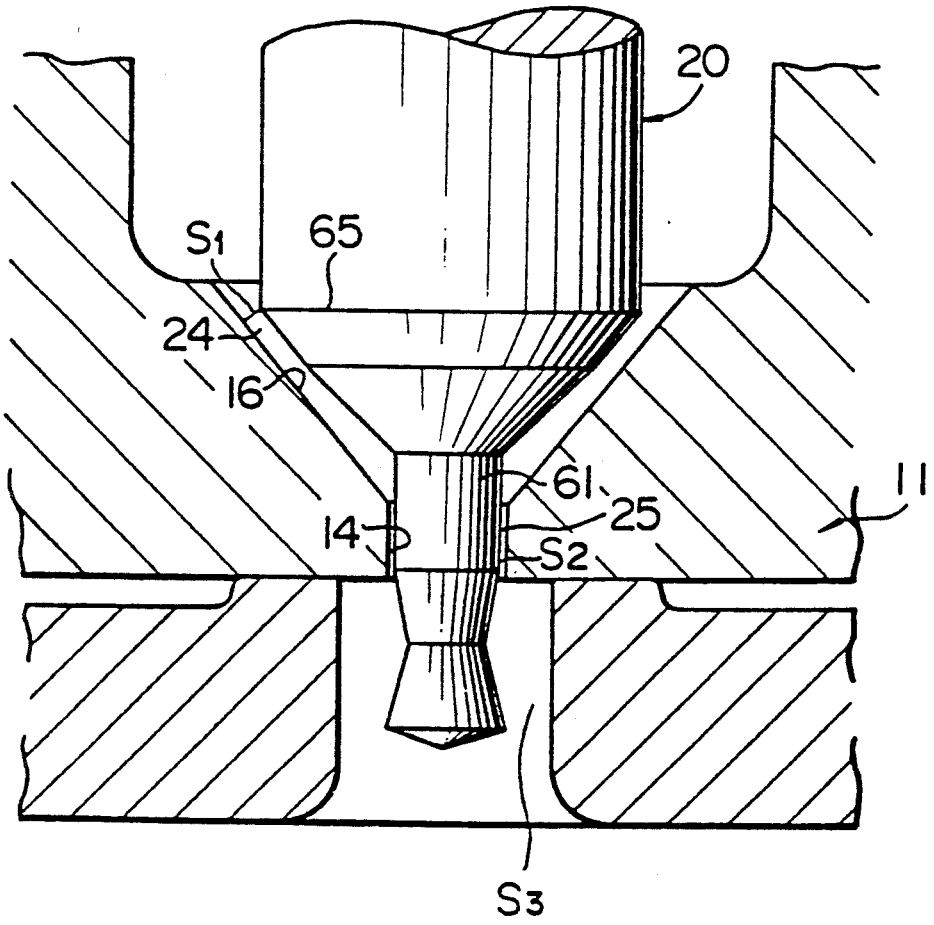
FIG. 17 PRIOR ART
FIG. 17 is a fragmental enlarged cross-sectional view of an end portion of the prior art fuel injection valve.

The conventional electromagnetic fuel injection valve shown in FIG. 17 performs the metering of fuel at two locations, that is, at the gap 24 (the metering area $S_1$) between the valve seat 16 formed on the valve body 11 and a ridge 65 on the valve member 20, and at the gap 25 (the metering area $S_2$) between the wall surface of the injection hole 14 formed in the valve body 11 and the peripheral surface of the pin section 61 of the valve member 20. The gap 25 is so set that a pressure reduction on the order of a restriction ratio $P_{drop}=70\%$ takes place at the gap 25. In this case, an area ratio $S_1/S_1$ between the metering sections is 0.62. In use of such a fuel injection valve incorporated in the fuel supply system, the combustion residue within the cylinder or the intake pipe or the evaporation residue in the fuel is deposited and accumulated at the gap 25, resulting in a reduction in the amount of injection.

Figure 14:
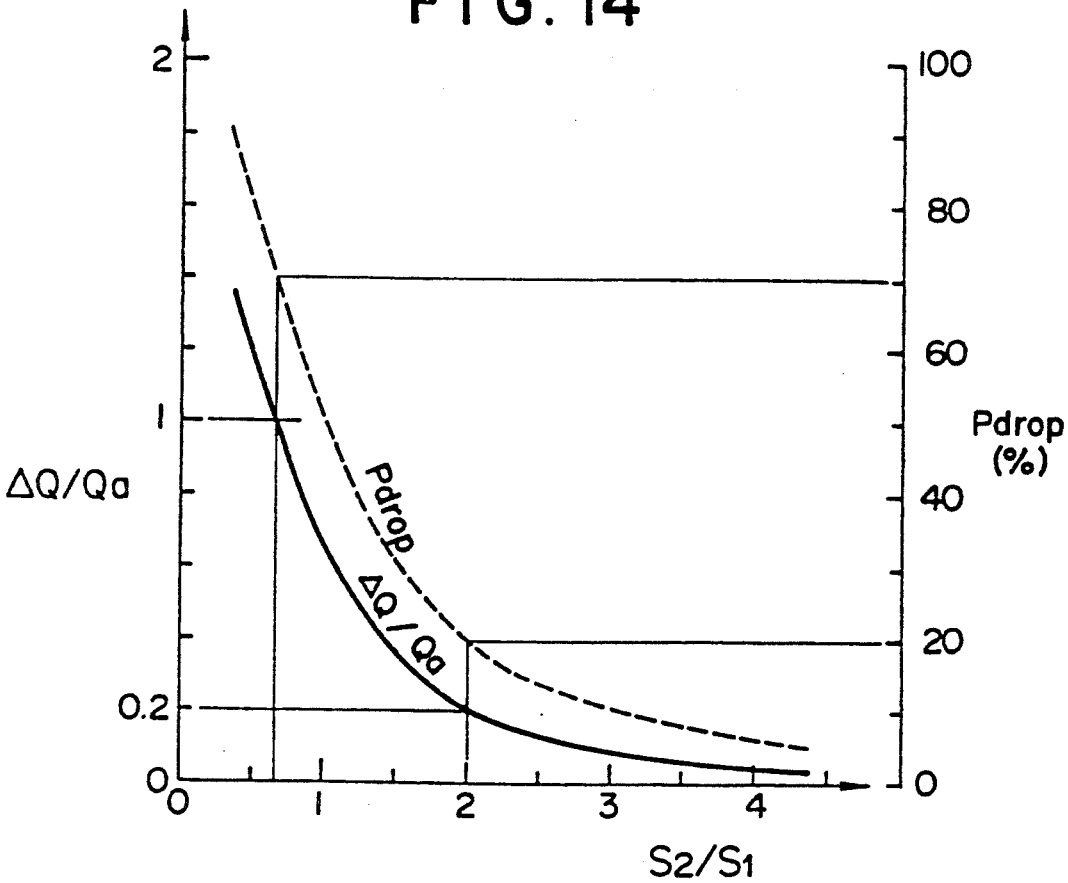
FIG. 14 is a graphical representation of the relationship between an area ratio $S_1/S_1$ between metering sections and a reduction degree $\Delta Q/\Delta Qa$ in an amount of injection, and the relationship between the area ratio $S_1/S_1$ between the metering sections and a restriction ratio Pdrop, in the fuel injection valve illustrated in FIGS. 11 through 13.

In view of the above, as a countermeasure, the following setting is effected in the embodiment illustrated in FIGS. 11 and 12. FIG. 14 shows the relationship (solid line) between the reduction degree $\Delta Q/Qa$ of the injected fuel and the area ratio $S_1/S_1$ between the metering sections, and the relationship (broken line) between the area ratio $S_1/S_1$ and the restriction ratio $P_{drop}$. In FIG. 14, the reduction degree $\Delta Q/Qa$ represents a proportion of an amount of reduction $\Delta Q$ of the injection when the residue is accumulated, with respect to the amount of injection Qa when no residue is accumulated. In case of the fuel injection valve illustrated in FIG. 11 in which a restriction ration $P_{drop}$ is equal to 70%, the reduction degree $\Delta Q/Qa$ is set to 1.

As will be clear from FIG. 14, the reduction degree $\Delta Q/Qa$ in the amount of injection varies correspondingly to the restriction ration $P_{drop}$. In order to prevent influence on the engine due to the reduction in the amount of injection, it is necessary to set the area ratio $S_1/S_1$ to at least 2 (or less than 20% of the restriction ratio $P_{drop}$) to restrain the reduction degree $\Delta Q/$ Qa in the amount of injection to at most 1/5.

To this end, in the embodiment illustrated in FIGS. 11 and 12, at no accumulation of residue, the metering area $S_1$ of the gap 24 and the metering area $S_2$ between the pin section 461 and the injection hole 14 are so set that the area ratio $S_1/S_1$ becomes at least 2. Accordingly, even if the residue R is deposited and accumulated on the outer periphery of the pin section 461 and the wall surface of the injection hole 14, the reduction ratio in the amount of injection can be restrained to 10% or less, thereby making it possible to prevent influence on the engine performance.

In FIG. 12, as the residue is accumulated on the region downstream of the valve seat 16 so that the passage area $S_4$ of the downstream region becomes smaller than the metering area $S_1$ of the gap 24, the amount of injection is reduced. To cope with this problem, the following setting is effected in the illustrated embodiment.

Figure 13:
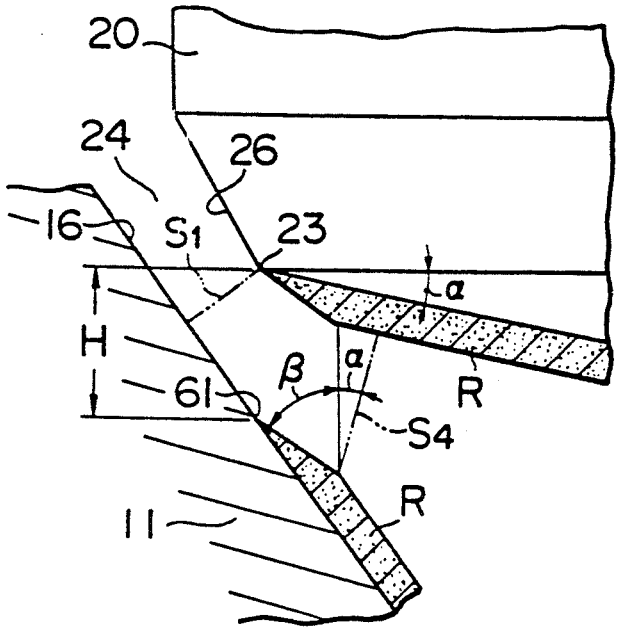
FIG. 13 is a fragmental enlarged view of a portion encircled by XIII in FIG. 12.

That is, assuming that the inclination angle of the tapered frustoconical section 460 downstream of the abutting part 23 on the valve member 20 is $\alpha$, the inclination angle in the downstream region of the valve seat 16 having accumulated thereon the residue is $\beta$, and the lift amount of the valve member 20 is H as shown in FIG. 13, and supposing that the diameter of the injection hole 14 is de, and the diameter of the abutting part 23 on the valve member 20 is ds as shown in FIG. 12, then the metering area $S_1$ of the gap 24 and the passage area $S_4$ downstream of the abutting part 23 having accumulated thereon the residue are represented as follows, respectively.

$$S_1 = \pi ds h \sin \beta$$

$$S_4 = \pi de H \cos \alpha$$

In order to prevent a reduction in the amount of injection due to the accumulation of residue, it is required to keep the passage area $S_4$ having accumulated thereat the residue always larger than the metering area $S_1$ of the gap 24. That is, from the relationship of $S_4 > S_1$, the following relationship must be maintained.

$$\text{Cos } \alpha > \frac{ds}{de} \sin \beta$$

Figure 15:
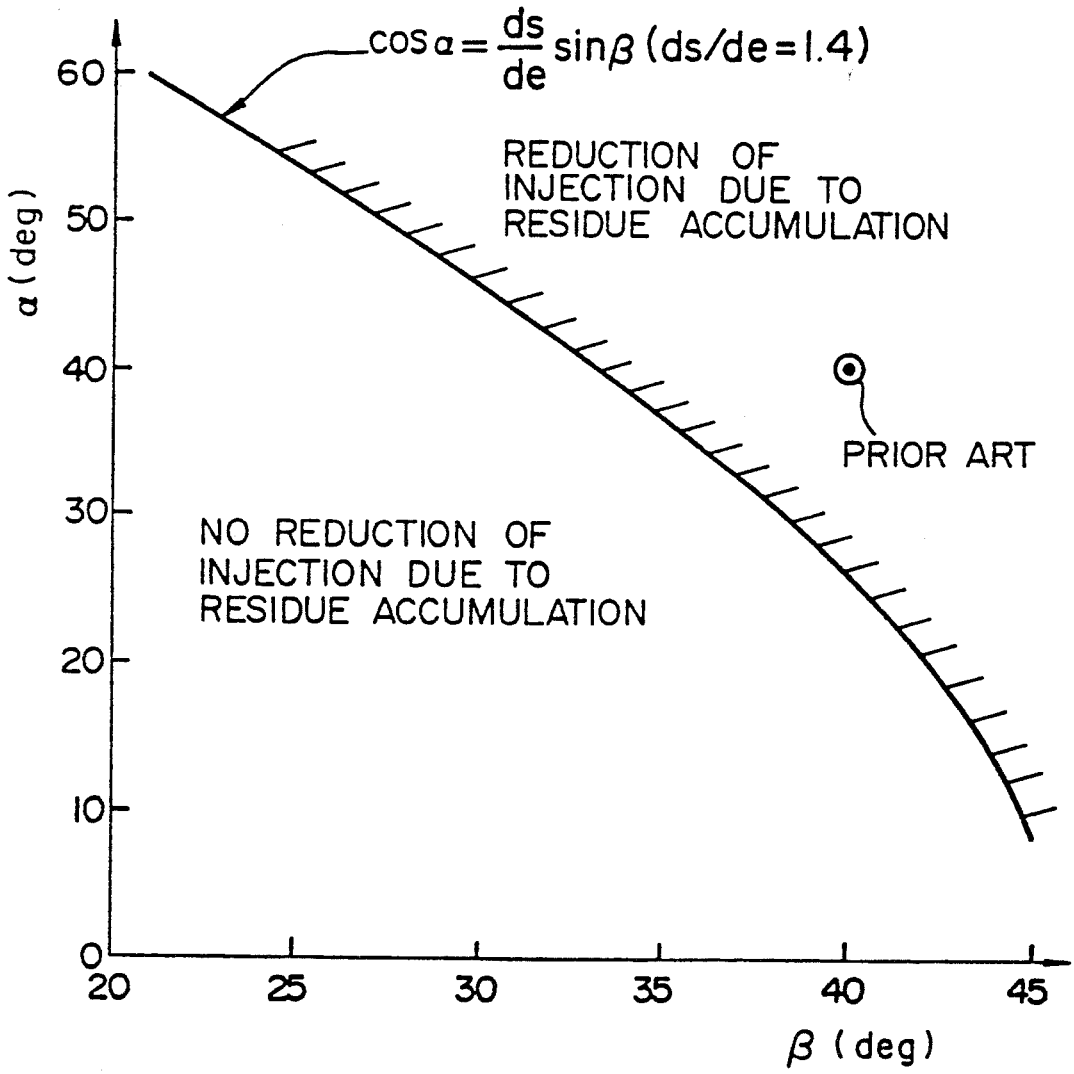
FIG. 15 is a graphical representation of the relationship between an inclination angle $\alpha$ of a conical surface and an inclination angle $\beta$ at a downstream region of a valve seat having accumulated thereon residue, in the fuel injection valve illustrated in FIGS. 11 through 3.

FIG. 15 shows the relationship between the inclination angle $\alpha$ of the section 460 and the inclination angle $\beta$ at the downstream region of the valve seat having accumulated thereon the residue, in case of ds/de = 1.4. In order to prevent a reduction in the amount of injection due to the accumulation of residue, the inclination angles $\alpha$ and $\beta$ should be so set as to be located in a range below the curve ($\cos\alpha = 1.4 \sin \beta$).

In this manner, if the inclination angle $\alpha$ of the section 460 downstream of the abutting part 23 and the inclination angle $\beta$ at the downstream region of the valve seat 16 having accumulated thereon the residue are so set as to have the relationship of $$\cos \alpha > \frac{ds}{de} \sin \beta,$$

it is possible to prevent a reduction in the amount of injection due to the accumulation of residue at the downstream region of the valve seat 16.

Moveover, if the metering area $S_2$ between the wall surface of the injection hole 14 and the peripheral surface of the pin section 461 is enlarged, a particle size of the sprayed fuel varies. Accordingly, in order to obtain a good spraying of the fuel to be injected to spread toward the downstream side by the flared section 463, the following setting is further effected in the illustrated embodiment. Incidentally, a good spraying is a spraying having a particle size of a few hundreds $\mu$m and having an adequate angle of spray (on the order of 20° in case of the injection into the intake pipe).

That is, as shown in FIG. 12, assuming that the diameter of the pin section 461 is dp and the diameter of the flared section 463 is da, then the metering area $S_2$ between the wall surface of the injection hole 14 and the peripheral surface of the pin section 461 and the effective area $S_3$ at the flared section 463 are represented as follows.

$$S_2 = \frac{\pi}{4} (de^2 - dp^2)$$

$$S_3 = \frac{\pi}{4} (da^2 - dp^2)$$

Figure 16:
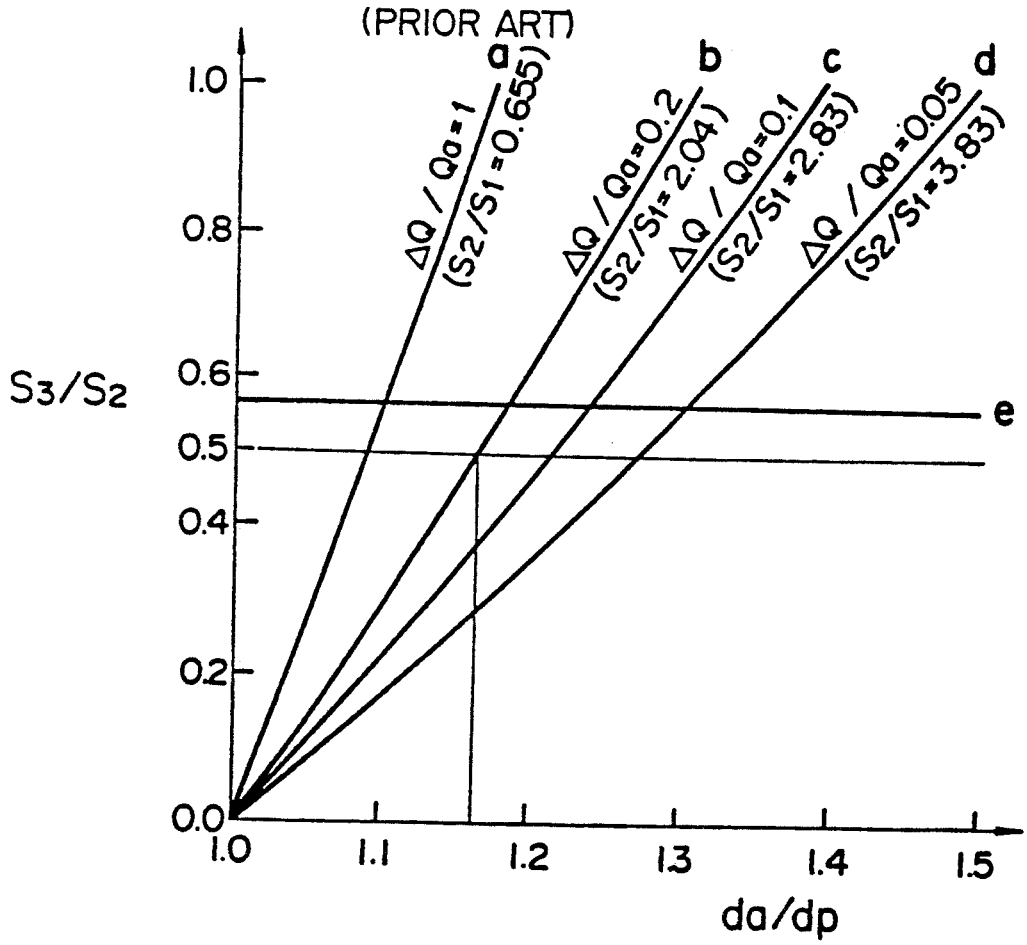
FIG. 16 is a graphical representation of the relationship of a ratio da/dp between a diameter dp of a pin section and a diameter da of an enlarged section, with respect to an area ratio $S_3/S_2$ between the metering sections, in the fuel injection valve illustrated in FIGS. 11 through 13.

In addition, FIG. 16 shows the relationship of a ratio da/dp between the diameter dp of the pin section 461 and the diameter da of the flared section 463, with respect to a ratio $S_3/S_2$ between the injection area $s_2$ and the effective area $S_3$ at the flared section 463. In FIG. 16, curves a to d represent the characteristics corresponding to the reduction degree $\Delta Q/$ Qa in the amount of injection (area ratio $S_1/S_1$ between the metering sections). The straight line a represents the characteristics of the fuel injection valve illustrated in FIG. 17 in which the reduction degree $\Delta Q/$ Qa in the amount of injection is equal to 1 and the area ratio $S_1/S_1$ between the metering sections is equal to 0.655. The straight line e in FIG. 16 represents the ratio $S_3/S_2$ between the injection area $S_2$ and the area $S_3$ at the flared section 463 in the fuel injection valve illustrated in FIG. 17.

Experimental study was conducted by the inventors of the present application on an arrangement in which the reduction degree $\Delta Q/$ Qa in the amount of injection is set to at most 0.2 or the area ratio $S_2/S_1$ between the metering sections is set to at least 2.04 as represented by the curves b, c and d, that is, on an arrangement in which the passage area $S_2$ is enlarged as in the embodiment illustrated in FIGS. 11 and 12. It was ascertained that if the area ratio $S_3/S_2$ was set to at least 0.5, it was possible to set the particle size of spray to a high quality particle size of 500 $\mu$m or less than the Zauder's mean particle size.

In view of the experiments, in the embodiment shown in FIGS. 11 and 12, the ratio da/dp is so set that the area ratio $S_3/S_2$ becomes 0.5 or more correspondingly to the reduction degree $\Delta Q/$ Qa in the amount of injection (area ratio $S_1/S_1$ between the metering sections). For example, in case the reduction degree $\Delta Q/$ Qa in the amount of injection is equal to 0.2, the ratio da/dp should be set to approximately 1.2 or more as shown in FIG. 16. Additionally, the angle of spray is regulated by the inclination angle of the flared section 463.

In this manner, if the ratio da/dp is so set that the ratio $S_3/S_2$ becomes 0.5 or more, a good spray can be obtained even if the metering area $S_2$ is enlarged for the purposes of prevention of a reduction in the amount of injection due to the accumulation of residue.

In the embodiment illustrated in FIGS. 11 and 12, since the annular flange 458 is formed on the valve member 20 to thereby define the annular gap 459, the fuel can flow in a circumferentially uniformly distributed fashion. Moreover, the flange 458 can be machined in such a manner that the valve member 20 having an enlarged diameter portion is prepared, and the relative rotation between the valve member 20 and a tool causes the tool to machine the enlarged diameter portion to form the flange 458. Further, after an amount of injection is measured, if it is desired to modify the diameter of the flange 458, the relative rotation between the valve member 20 and the tool enables the same to machine the flange 458 to modify the diameter thereof. Thus, the machining of the flange 458 is easy, and then the precise machining can be effected on the flange 458, thereby making it possible to precisely set the gap 459.

The invention should not be limited to the specific embodiment shown in FIGS. 11 to 16.

Specifically, the embodiment illustrated in FIGS. 11 to 16 has been described as having the flange 458 which is disposed between the upstream and the downstream sliding sections 21 and 22. As in an embodiment shown in FIG. 18, however, a disc flange **458*a* may be formed between the downstream sliding section 22 and the abutting part 23 on the valve member 20 to define an annular gap 459*a*** serving as a fuel metering orifice.

Figure 19:
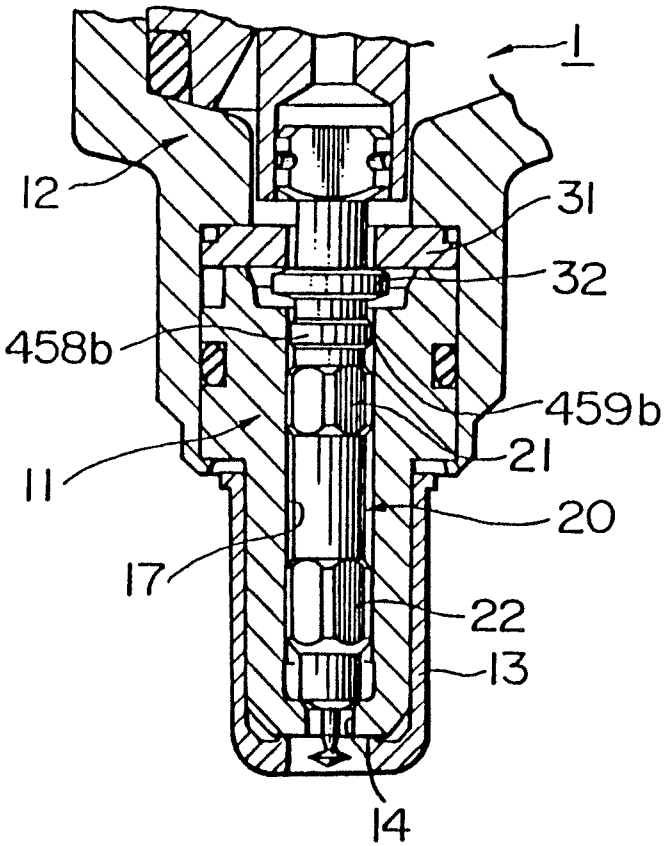
FIG. 19 is a view similar to FIG. 18, but showing still another embodiment of the invention.

Moreover, as in an embodiment shown in FIG. 19, a disc flange **458*b* may be formed between the upstream sliding section 21 and the flange 32 of the valve member 20 to define an annular gap 459*b*** serving as a fuel metering orifice.

Figure 18:
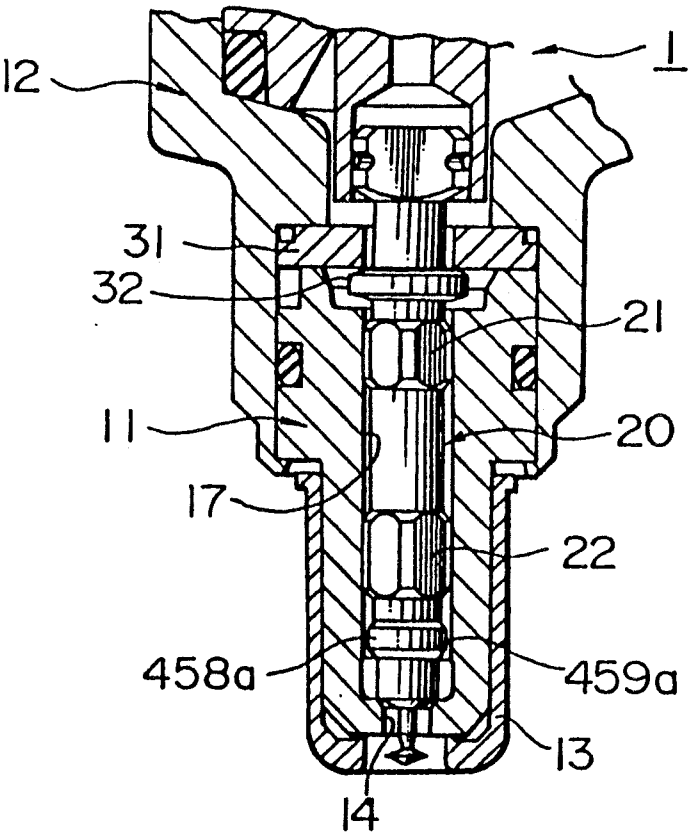
FIG. 18 is a fragmental cross-sectional view showing a fuel injection valve according to another embodiment of the invention.

Other features, arrangements and functions of each of the embodiments illustrated in FIGS. 18 and 19 are similar to those of the embodiment shown in FIGS. 1 to 4, and the description thereof will therefore be omitted.

Still another embodiment of the invention will be described with reference to FIG. 20.

Figure 20:
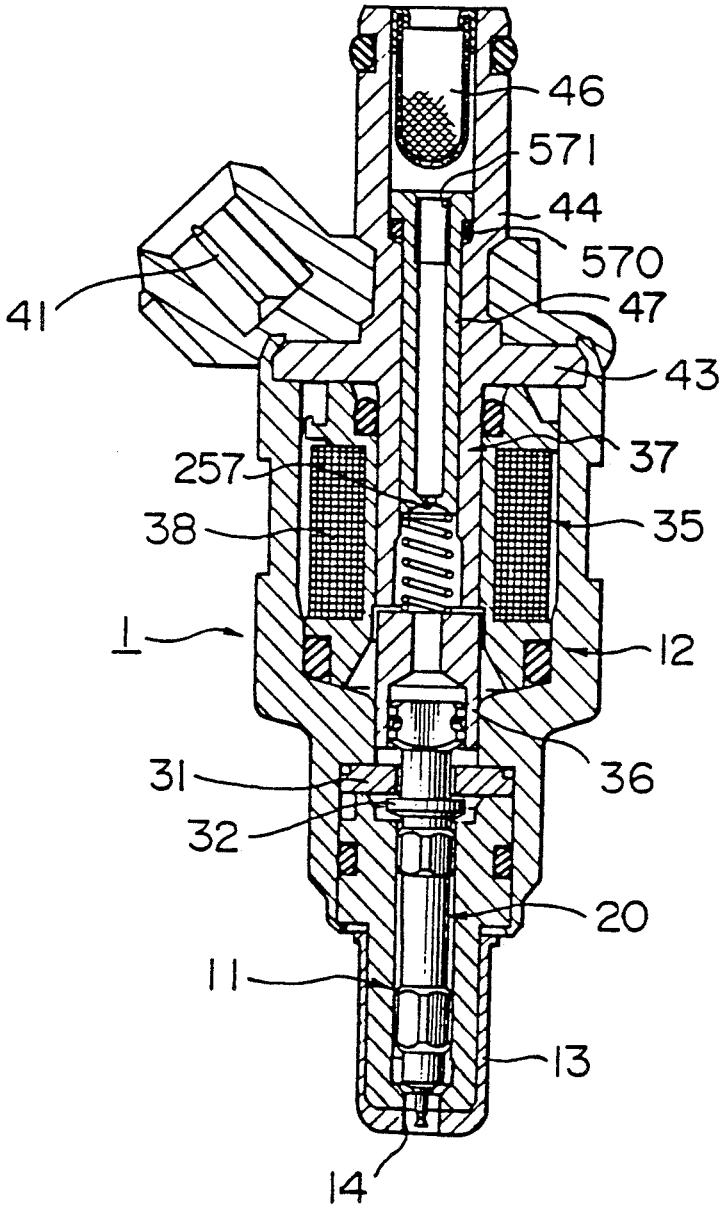
FIG. 20 is a view similar to FIG. 1, but showing another embodiment of the invention.

As shown in FIG. 20, in the embodiment the orifice 257 serving as fuel metering means is provided in the adjusting pipe 47, and an O-ring 570 is interposed between the adjusting pipe 47 and the stator 37.

For the arrangement of the embodiment illustrated in FIG. 20, it is difficult to meter the fuel delivered to the fuel metering gap 24 only by the passage area of the orifice 257 because a gap is present between the adjusting pipe 47 and the stator 37.

Accordingly, if the O-ring 570 is interposed between the adjusting pipe 47 and the stator 37 as in the embodiment illustrated in FIG. 20, it is possible to meter the fuel only by the passage area of the orifice 257, because no fuel leaks through the gap between the adjusting pipe 47 and the stator 37. Thus, the precise metering of the fuel by the orifice 257 is made possible.

Figure 21:
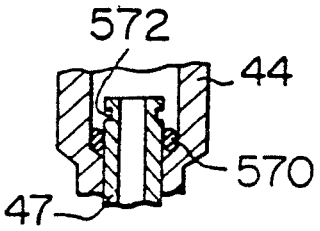
FIG. 21 is a fragmental view showing a modification of the fuel injection valve illustrated in FIG. 20.
Figure 22:
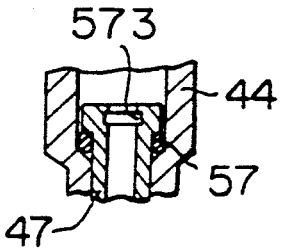
FIG. 22 is a view similar to FIG. 21, but showing another modification of the fuel injection valve illustrated in FIG. 20.

In the arrangement in which the O-ring 570 is interposed between the adjusting pipe 47 and the stator 37, if the adjusting pipe 47 is excessively depressed, it would become difficult to return the adjusting pipe 47. Accordingly, in this embodiment, threads 571 for use in return of the adjusting pipe 47 are formed on the inner peripheral surface thereof. As another measure for returning the adjusting pipe 47, grooves 572 and 573 for use in return of the adjusting pipe 47 may be formed respectively on the outer and the inner peripheral surfaces of the adjusting pipe 47 as shown respectively in FIGS. 21 and 22.

Although the embodiment illustrated in FIG. 20 has been described as having the O-ring 570 which is interposed between the adjusting pipe 47 and the stator 37, any other seal means may be used if it can prevent leakage of the fuel through the gap between the adjusting pipe 47 and the stator 37.

Figure 23:
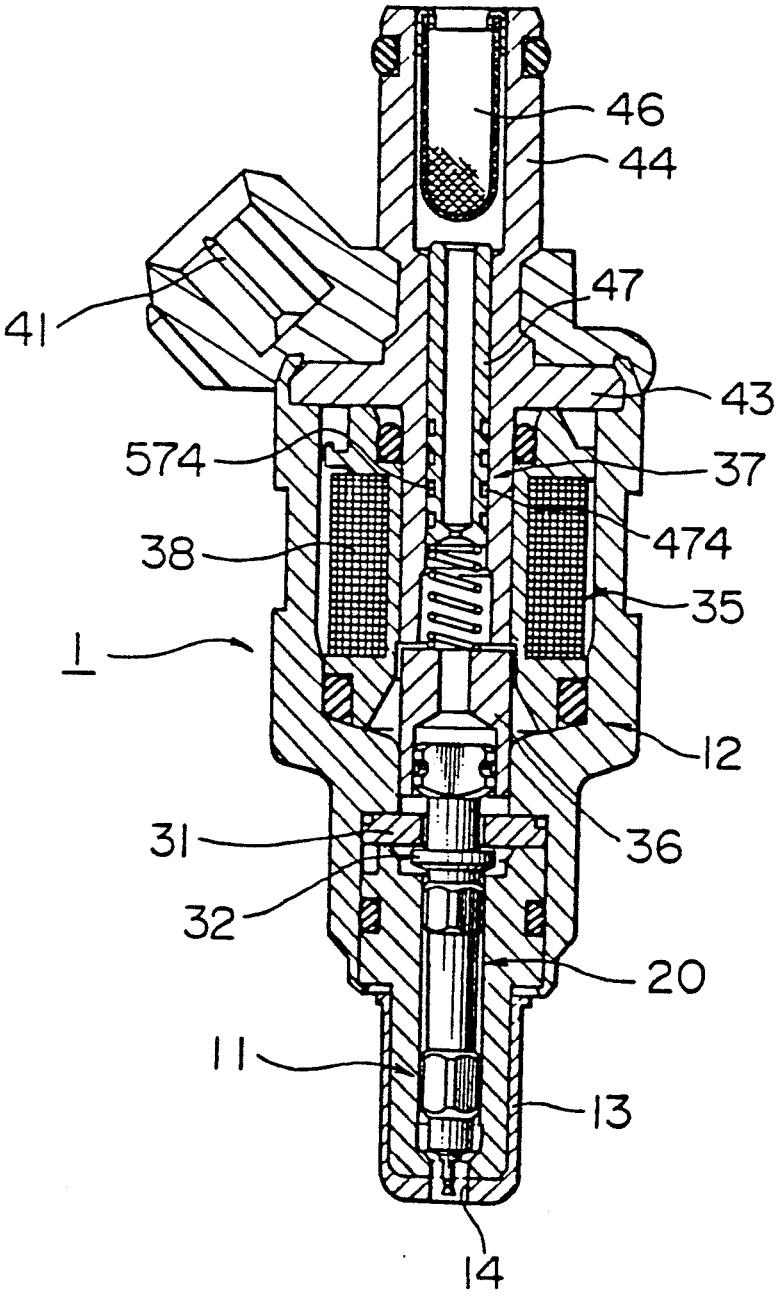
FIG. 23 is a view similar to FIG. 20, but showing still another modification of the fuel injection valve illustrated in FIG. 20.

Moreover, as shown in FIG. 23, in place of the seal member, a plurality of grooves 474 and 574 may be formed on the outer peripheral surface of the adjusting pipe 47. In this case, the flow velocity of the fuel is considerably changed across the grooves 474 and 574 to increase the pressure drop, thereby making it difficult for the fuel to pass through the gap between the adjusting pipe As described above, the arrangement of the electromagnetic fuel injection valve for an internal combustion engine according to the invention is such that the metering means is located upstream of where the abutting part abuts the valve seat portion with reference to the flow direction of the fuel. By virtue of such arrangement, when the valve member is closed, the surfaces, which function to meter the fuel quantity of the fuel which is injected from the injection hole, are out of direct communication with the interior of the cylinder or the interior of the intake pipe by the abutting part abutting the valve seat portion. This prevents the combustion residue within the cylinder or the intake pipe or the evaporation residue in the fuel from being deposited and accumulated on the metering portion and the portion of the valve seat cooperating with the metering section defining portion to define therebetween the fuel metering gap. Thus, it is possible to always maintain the metered fuel amount constant. Further, no highly precise machining is required to prevent the deposition and accumulation of the residue, in contradistinction to the previously described prior art, making it possible to restrain an increase in the cost due to the highly precise machining.

What is claimed is:

1. An electromagnetic fuel injection valve for use in an internal combustion engine, said valve comprising:

an electromagnetic coil;

a cylindrical stator core disposed within said electromagnetic coil;

an armature disposed to oppose one end of said stator core;

a valve member connected to said armature;

a valve body holding therein said valve member, said valve body having an end portion provided with a valve seat on which an end portion of said valve member is to be contacted, and said valve body defining a minimum metering gap between the end portion of said valve body and the end portion of said valve member when said valve member is in an open position;

a cylindrical adjusting pipe disposed within said stator core;

spring means disposed between said adjusting pipe and said armature for biasing said armature; and metering passage means provided within said adjusting pipe, said metering passage means defining a second minimum dimension, wherein fuel is injected from said electromagnetic fuel injection valve due to a predetermined pressure loss generated in said metering passage means and a pressure loss generated in said minimum metering gap.

2. An electromagnetic fuel injection valve according to claim 1, wherein said valve further comprises a fuel supply pipe connected to the other end of said stator core.

3. An electromagnetic fuel injection valve according to claim 1, wherein said metering passage means is formed integrally with said adjusting pipe by means for reducing an inner diameter of said adjusting pipe.

4. An electromagnetic fuel injection valve for use in an internal combustion engine, said valve comprising:

an electromagnetic coil;

a cylindrical stator core disposed within said electromagnetic coil;

an armature disposed to oppose one end of said stator core;

a valve member connected to said armature;

a valve body incorporating therein said valve member, said valve body having an end portion provided with a valve seat on which an end portion of said valve member is to be contacted, and said valve body defining a minimum metering gap between the end portion of said valve body and the end portion of said valve member when said valve member is in an open position;

a cylindrical adjusting pipe disposed within said stator core;

a spring disposed between said adjusting pipe and said armature for biasing said armature; and metering passage means provided within said adjusting pipe, said metering passage means having a dimension larger than a dimension of said metering gap and smaller than that of any other fuel passage in said electromagnetic fuel injection valve, wherein fuel is injected from said electromagnetic fuel inejction valve due to a predetermined pressure loss generated in said metering passage means and a pressure loss generated in said minimum metering gap.

5. An electromagnetic fuel injection valve according to claim 4, wherein said valve further comprises a fuel supply pipe connected to the other end of said stator core.

6. An electromagnetic fuel injection valve according to claim 4, wherein said metering passage means is formed integrally with said adjusting pipe by means for reducing an inner diameter of said adjusting pipe.

7. An electromagnetic fuel injection valve for use in an internal combustion engine, said valve comprising:

an electromagnetic coil;

a cylindrical stator core disposed within said electromagnetic coil;

an armature disposed to oppose one end of said stator core;

a valve member connected to said armature;

a valve body holding therein said valve member, said valve body having an end portion provided with a valve seat on which an end portion of said valve member is to be contacted, and said valve body defining a minimum metering gap between the end portion of said valve body and the end portion of said valve member when said valve member is in an open position;

a cylindrical adjusting pipe disposed within said stator core;

a spring disposed between said adjusting pipe and said armature for biasing said armature; and metering passage means provided within said adjusting pipe at a downstream end portion thereof, said meterign passage means having a second minimum dimension, wherein fuel is injected from said electromagnetic fuel injection valve due to a predetermined pressure loss generate din said metering passage means and a pressure loss generated in said minimum metering gap.

8. An electromagnetic fuel injection valve according to claim 7, wherein said valve further comprises a fuel supply pipe connected to the other end of said stator core.

9. An electromagnetic fuel injection valve according to claim 7, wherein said metering passage means is formed integrally with said adjusting pipe by means for reducing an inner diameter of said adjusting pipe.

* * * * *